US009326343B2

(12) United States Patent
Yan et al.

(10) Patent No.: US 9,326,343 B2
(45) Date of Patent: Apr. 26, 2016

(54) INTEGRATED LED DIMMER CONTROLLER

(71) Applicant: iWatt Inc., Campbell, CA (US)

(72) Inventors: Liang Yan, Milpitas, CA (US); Clarita C. Poon, Pleasanton, CA (US); Yimin Chen, Palatine, IL (US); Mark Eason, Hollister, CA (US); Chuanyang Wang, San Jose, CA (US)

(73) Assignee: Dialog Semiconductor Inc., Campbell, CA (US)

( * ) Notice: Subject to any disclaimer, the term of this patent is extended or adjusted under 35 U.S.C. 154(b) by 197 days.

(21) Appl. No.: 13/939,120

(22) Filed: Jul. 10, 2013

(65) Prior Publication Data

US 2014/0021885 A1 Jan. 23, 2014

Related U.S. Application Data

(60) Provisional application No. 61/672,680, filed on Jul. 17, 2012.

(51) Int. Cl.
*H05B 33/08* (2006.01)

(52) U.S. Cl.
CPC ..... *H05B 33/0845* (2013.01)

(58) Field of Classification Search
CPC ..... H05B 33/0845
USPC ..... 315/291, 209 R, 224, 200 R, 307–308, 315/149–159
See application file for complete search history.

(56) References Cited

U.S. PATENT DOCUMENTS

| | | | | |
|---|---|---|---|---|
| 8,674,615 | B2 * | 3/2014 | Koutensky et al. | 315/219 |
| 8,963,437 | B2 * | 2/2015 | Wu et al. | 315/200 R |
| 2008/0224633 | A1 | 9/2008 | Melanson et al. | |
| 2010/0308749 | A1 | 12/2010 | Liu | |
| 2012/0212151 | A1 | 8/2012 | Chu | |

FOREIGN PATENT DOCUMENTS

| | | | |
|---|---|---|---|
| CN | 101909386 | A | 12/2010 |
| CN | 202261910 | U | 5/2012 |
| JP | H 5-251187 | | 9/1993 |
| JP | H 7-274497 | | 10/1995 |
| JP | 2008-270044 | A | 11/2008 |
| JP | 2012-134187 | A | 7/2012 |

(Continued)

OTHER PUBLICATIONS

European Patent Office, Search Report and Opinion, European Patent Application No. 13176945.7, Dec. 6, 2013, eight pages.

(Continued)

*Primary Examiner* — Dinh Le
(74) *Attorney, Agent, or Firm* — Fenwick & West LLP

(57) ABSTRACT

An integrated LED controller drives and reads a passive dimmer and controls a power circuit for the LED. The integrated LED controller detects changes in the position of the passive dimmer and causes the power circuit to brighten or dim the LED accordingly. These functions are normally performed by multiple discrete components. However, the integrated LED controller is implemented as a single integrated circuit, thus reducing the size and cost of the LED dimming system. The integrated LED controller can also include a unified timing controller that coordinates the timing of multiple functions within the controller in a manner that reduces the noise sensitivity of the controller.

23 Claims, 7 Drawing Sheets

(56) References Cited

FOREIGN PATENT DOCUMENTS

| | | | |
|---|---|---|---|
| TW | M428618 | | 5/2012 |
| TW | M429287 | | 5/2012 |
| WO | WO 2008/112735 | A2 | 9/2008 |
| WO | WO 2008/129485 | A1 | 10/2008 |
| WO | WO 2013/103538 | A1 | 7/2013 |

OTHER PUBLICATIONS

Chinese First Office Action, Chinese Application No. 201310308706.X, Jan. 5, 2015, 11 pages.

European Examination Report, European Application No. 13176945.7, Oct. 13, 2014, 7 pages.

European Examination Report, European Application No. 13176945.7, Jun. 26, 2015, 5 pages.

Japanese Office Action, Japanese Application No. 2013-148714, Jul. 1, 2014, 6 pages.

Japanese Office Action, Japanese Application No. 2013-148714, May 12, 2015, 5 pages.

Taiwan Office Action, Taiwan Application No. 102125621, Jun. 18, 2015, 12 pages (with Concise Explanation of Relevance).

European Examination Report, European Application No. 13176945.7, Nov. 18, 2015, 7 pages.

* cited by examiner

INTEGRATED LED DIMMER CONTROLLER

CROSS REFERENCE TO RELATED APPLICATION

This application claims the benefit of U.S. Provisional Application No. 61/672,680, filed Jul. 17, 2012, which is incorporated by reference herein in its entirety.

FIELD OF THE INVENTION

The present invention relates to driving LED (Light Emitting Diode) lamps and, more specifically, to controllers for dimming LED lamps based on a passive dimmer device.

BACKGROUND

LED lamps are being adopted in a wide variety of lighting applications. Compared to conventional lighting sources, such as incandescent lamps and fluorescent lamps, LEDs have significant advantages, including high efficiency, good directionality, color stability, high reliability, long lifetime, small size, and environmental safety.

When an LED lamp is used in place of an incandescent lamp in conjunction with a passive dimmer, several different components are need to perform tasks such as driving the dimmer, reading the output, and translating the dimmer curve. These components occupy a significant amount of space, and a complicated power circuit is needed to provide an appropriate power source to each component.

SUMMARY

In a system for dimming an LED, an integrated LED controller drives and reads a passive dimmer and controls a power circuit for the LED. The integrated LED controller detects changes in the control position of the passive dimmer and causes the power circuit to brighten or dim the LED accordingly. These functions are normally performed by multiple discrete components. However, the integrated LED controller is implemented as a single component (e.g., a single integrated circuit), thus reducing the size and cost of the LED dimming system. The integrated LED controller can also include a unified timing controller that coordinates the timing of multiple functions within the controller in a manner that decreases the system's sensitivity to noise (e.g., from an AC source that provides power to the system) and reduces noise in the control signals that the controller provides to the power circuit.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the embodiments of the present invention can be readily understood by considering the following detailed description in conjunction with the accompanying drawings.

OVERVIEW

The Figures (FIG.) and the following description relate to preferred embodiments of the present invention by way of illustration only. It should be noted that from the following discussion, alternative embodiments of the structures and methods disclosed herein will be readily recognized as viable alternatives that may be employed without departing from the principles of the claimed invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

Figure 1:
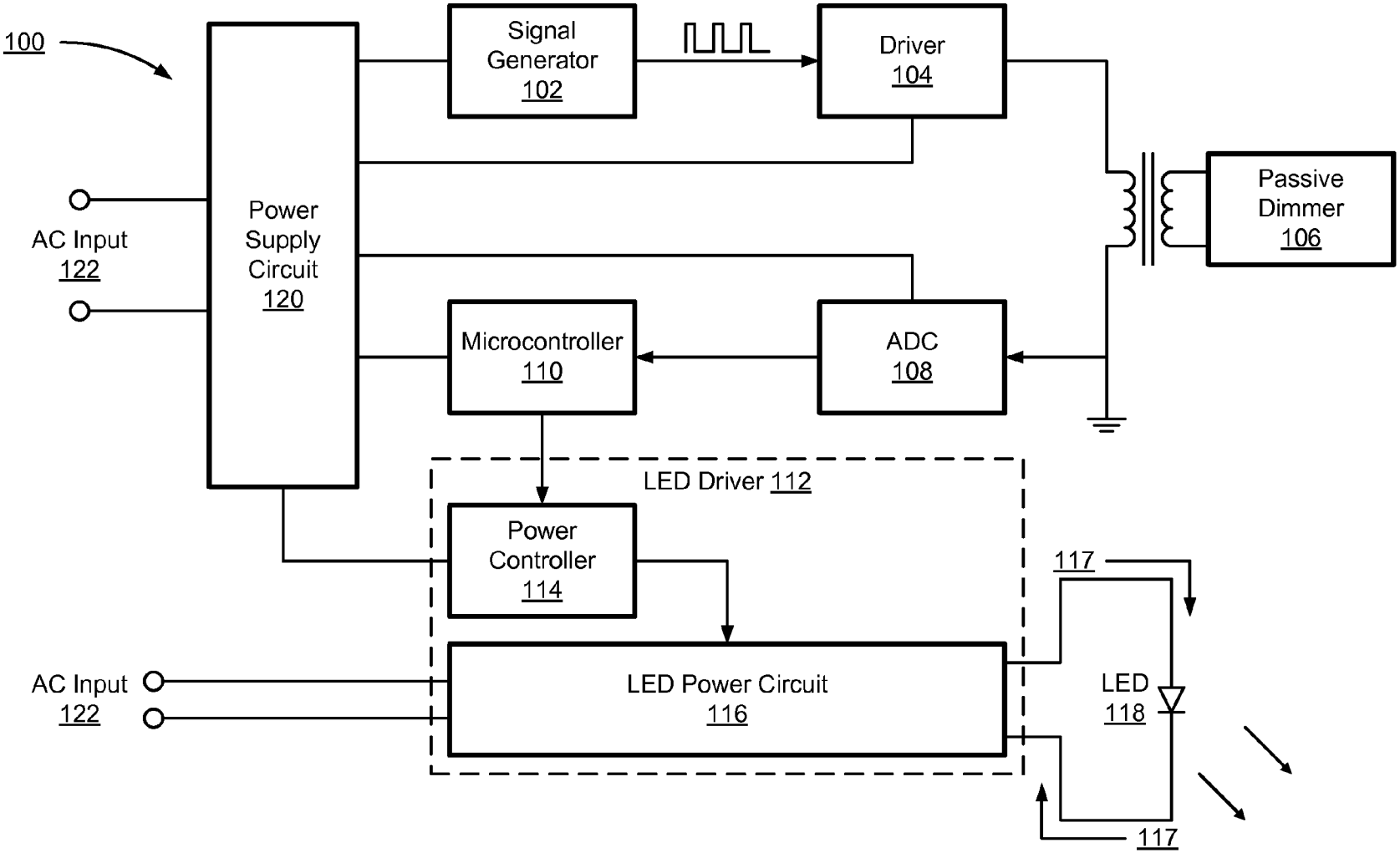
FIG. 1 block diagram of a conventional system for dimming an LED.

FIG. 1 illustrates a conventional system 100 for dimming an LED 118. The conventional system 100 includes a signal generator 102, a driver 104, a passive dimmer 106, an analog-to-digital converter (ADC) 108, a microcontroller 110, an LED driver 112, an LED 118, and a power supply circuit 120. The LED driver 112 includes a power controller 114 and an LED power circuit 116.

The signal generator 102 generates a pulse train that controls the driver 104, and the driver 104 outputs a driving current with a duty cycle based on the pulse train. The position of the passive dimmer 106 controls the voltage at the input of the ADC 108. The ADC 108 converts the voltage from the passive dimmer 106 into a digital signal, and the microcontroller 110 maps the signal from the ADC 108 to a desired brightness level for the LED 118.

The microcontroller 110 outputs a digital signal representing the desired brightness to the LED driver 112. The power controller 114 in the LED driver 112 receives the digital signal and generates one or more power control signals that cause the LED power circuit 116 to generate a driver current 117. The driver current 117 causes the LED 118 to emit light at the desired brightness. Thus, the conventional system 100 allows a user to adjust the brightness of the LED 118 by changing the position of the passive dimmer 106.

There are several drawbacks to the conventional system 100 described with reference to FIG. 1. In the conventional system 100, the signal generator 102, driver 104, ADC 108, microcontroller 110, and power controller 114 are discrete components. In FIG. 1 and in the subsequent system diagrams 200, 400 shown in FIGS. 2 and 4, discrete components are represented with thicker outlines.

If these components 102, 104, 108, 110, 114 are all placed on a single printed circuit board, then the components 102, 104, 108, 110, 114 and the traces that carry signals between them occupy a significant amount of space on the board. Meanwhile, if the components 102, 104, 108, 110, 114 are placed on multiple boards or inside separate housings, then the system 100 occupies a larger volume. In both implementations, the use of discrete components 102, 104, 108, 110, 114 increases the size and cost of the system 100. In addition, a complicated power supply circuit 120 is needed to supply electrical power to all five components 102, 104, 108, 110, 114, which also adds size and cost.

The conventional system 100 is also sensitive to noise, especially when the LED power circuit 116 is operating at a high power level, or when the AC input 122 undergoes a sharp voltage transition. One source of noise is the AC input 122 and can propagate through the LED power circuit 116 and other components in the system 100 to cause flickering and other undesirable effects in the brightness output of the LED 118.

Figure 2:
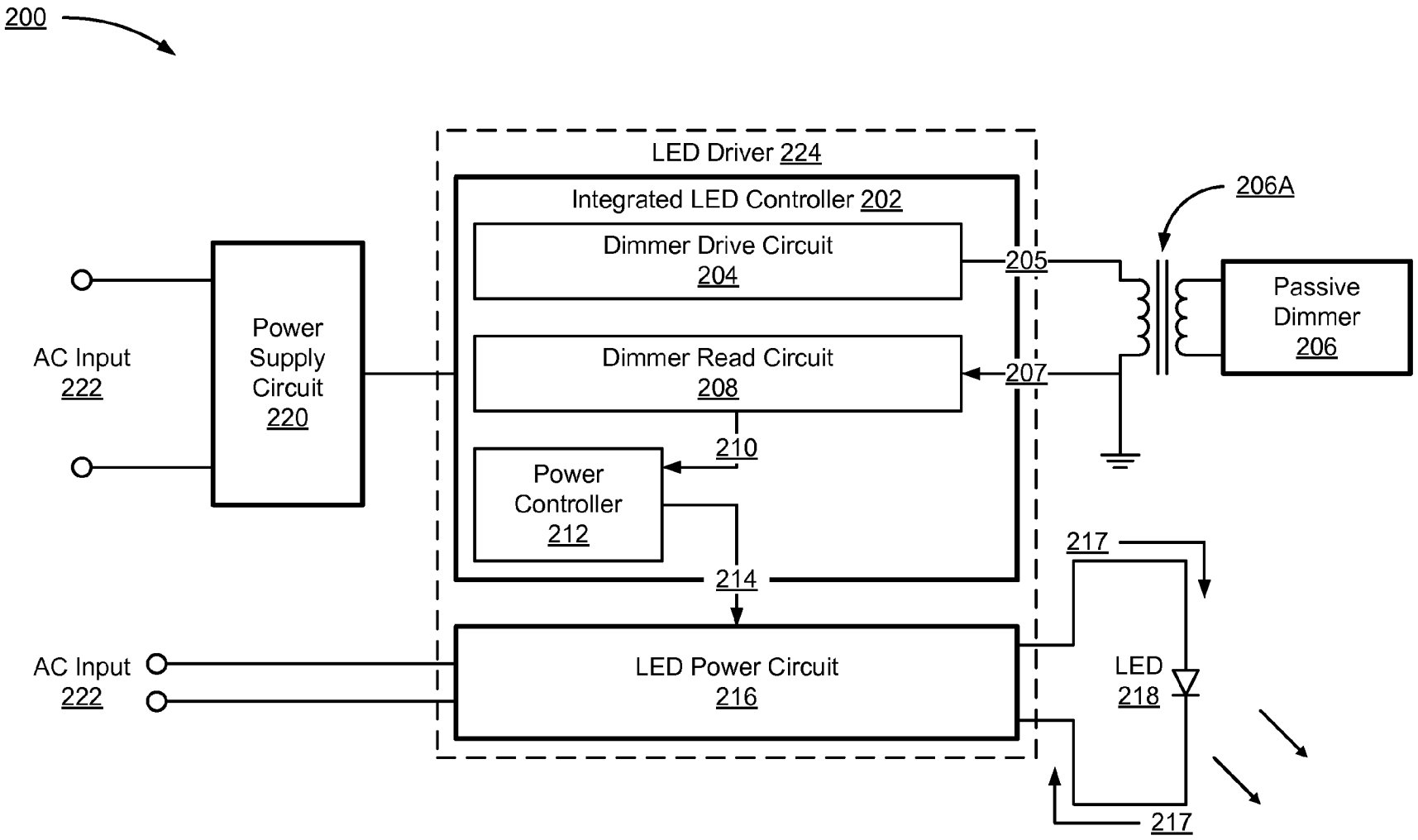
FIG. 2 is a block diagram of a system for dimming an LED with one embodiment of an integrated LED controller.

FIG. 2 is a block diagram illustrating a system 200 for dimming an LED 218 with one embodiment of an integrated LED controller 202. The integrated LED controller 202 is part of an LED driver 224 that also includes an LED power circuit 216. The system 200 also contains a power supply circuit 220, a passive dimmer 206, and an LED 218.

The integrated LED controller 202 is a single discrete component that includes a dimmer drive circuit 204, a dimmer read circuit 208, and a power controller 212. In one embodiment, the integrated LED controller 202 is implemented as a single integrated circuit. At a high level, the integrated LED controller 202 sends a driving signal 205 to the passive dimmer 206, receives an analog dimmer signal 207 that represents the control position of the passive dimmer 206, and generates one or more power control signals 214 that cause the LED power circuit 216 to generate a driver current 217 for the LED 218.

The dimmer drive circuit 204 of the integrated LED controller 202 generates a driving signal 205 for the passive dimmer 206. In one embodiment, the driving signal 205 has a constant current with a magnitude of approximately 1 milliampere (mA) to the passive dimmer 206. The driving signal 205 may also have a duty cycle. For example, the dimmer drive circuit 204 may alternate between a high current output (e.g., 1 mA) for 5 milliseconds (ms) and a low current output (e.g., 0 mA) for 10 ms to generate a driving signal 205 with a duty cycle of 33%. The functionality of the dimmer drive circuit 204 is described in detail with reference to FIG. 3A.

The passive dimmer 206 is an electromechanical device that causes an analog dimmer signal 207 to vary based on the control position of a physical control device, such as a slider or a knob. For ease of description, the control device is hereinafter referred to as a slider, and the control position is hereinafter referred to as the slider position. However, any other type of control device may be used. In one embodiment, the slider controls a potentiometer inside the passive dimmer 206, and the position of the slider controls the output voltage of the passive dimmer 206. In particular, the output voltage is at a minimum voltage when the slider is at a minimum position, and the output voltage is at a maximum voltage when the slider is at a maximum position. When the slider is at an intermediate position between the minimum and maximum positions, the output voltage is at an intermediate voltage between the minimum and maximum voltages. The dimmer 206 may be coupled to a transformer 206A to map the output voltage of the dimmer 206 to a lower voltage that is more suitable to be read by the dimmer read circuit 208. Additional electronic components, such as bypass capacitors, diodes, and transistors, may also be coupled to the dimmer 206, but these components are omitted from FIG. 2 for the sake of clarity.

In one embodiment, the passive dimmer 206 is a 0-10 volt (V) dimmer, which means the output voltage of the dimmer 206 is approximately 0 V when the slider is at the minimum position, and the output voltage is approximately 10 V when the slider is at the maximum position. When the slider is in an intermediate position between the minimum and maximum positions, the dimmer output voltage is between 0 V and 10 V. The output voltage of the dimmer 206 may alternatively be at a minimum voltage that is greater than 0 V (e.g., 1 V or 1.2 V) when the slider is at the minimum position. The relationship between the dimmer output voltage and the position of the slider is typically linear. However, the dimmer output voltage and the slider position may instead have a non-linear relationship, such as a quadratic, exponential, or logarithmic relationship. As described above, the passive dimmer 206 may be coupled to a transformer 206A that maps the dimmer output voltage to a lower voltage. For example, the analog dimmer signal 207 may range from 0-2 V when a 0-10 V dimmer 206 is used.

In some embodiments, the dimmer 206 is a digital dimmer that receives the driving signal and outputs a digital value representing the slider position. In these embodiments, the integrated LED controller 202 receives a digital dimmer signal 207 instead of an analog dimmer signal.

The integrated LED controller 202 routes the analog dimmer signal 207 to the dimmer read circuit 208, and the dimmer read circuit 208 generates a digital brightness signal 210 that represents a desired brightness level corresponding to the analog dimmer signal 207. The functionality of the dimmer read circuit 208 is described in detail with reference to FIG. 3B.

The power controller 212 receives the digital brightness signal 210 from the dimmer read circuit 208 and generates one or more power control signals 214 that are sent from the integrated LED controller 202 to the LED power circuit 216. The power control signals 214 are signals that cause the LED power circuit 216 to generate a driver current 217 that causes the LED 218 to emit light at a brightness corresponding to the digital brightness signal 210. For example, the control signals 214 may control portions of the LED power circuit 216 that determine the duty cycle, frequency, or magnitude of the driver current 217.

The LED power circuit 216 is a circuit that uses an alternating current (AC) input 222 to generate a driver current 217 for the LED 218. As described above with reference to the power controller 212, the driver current 217 varies based on the power control signals 214 that the LED power circuit 216 receives from the integrated LED controller 202. The LED power circuit 216 may include various circuit components that are known in the art, such as a bridge rectifier, amplifier, voltage regulator, transformer, and flyback converter, and different power control signals 214 may be used to control different components of the circuit. In one embodiment, the LED power circuit 216 includes a boost converter and a flyback converter, and the power control signals 214 include control signals for the switches in the boost converter and the flyback converter. This embodiment is described in further detail with reference to FIG. 6.

The power supply circuit 220 converts an AC input 222 to a direct current (DC) input that powers the integrated LED controller 202. Similar to the LED power circuit 216, the power supply circuit 220 may also include various circuit components that are known in the art. In the embodiment shown in FIG. 2, the power supply circuit 220 and the LED power circuit 216 are two separate components. However, the power supply circuit 220 and the LED power circuit 216 may also be combined into a single power circuit that provides a DC input for the integrated LED controller 202 and a driver current 217 for the LED 218.

As described above, the integrated LED controller 202 shown in FIG. 2 is embodied as a single component, which beneficially reduces the size, cost, and complexity of the LED driver 224 and the entire LED dimming system 200. In addition, since the functions for driving and reading the dimmer and for generating the control signals 214 are all performed by the integrated LED controller 202, the power supply circuit 220 can be configured to power only a single component. As a result, the power supply circuit 220 can be made smaller, thus allowing for an additional reduction in the size, cost, and complexity of the LED dimming system 200.

Figure 3A:
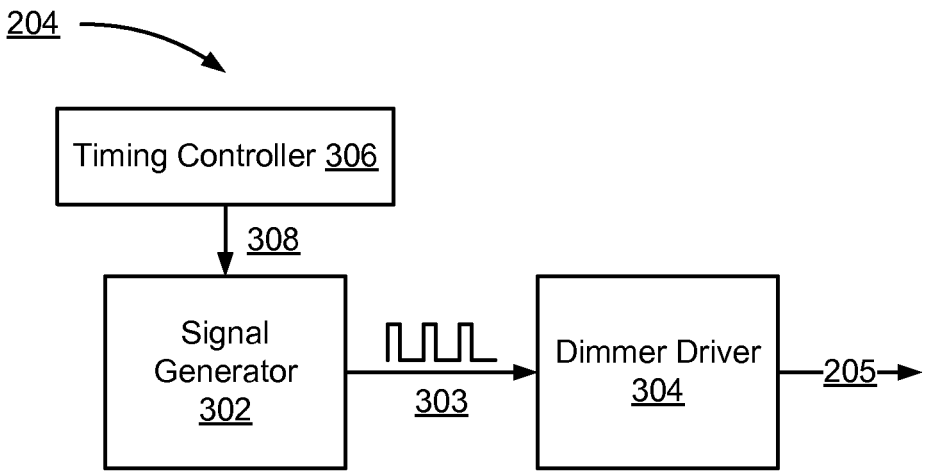
FIG. 3A is a block diagram of the dimmer drive circuit of the integrated LED controller, according to one embodiment.

FIG. 3A is a block diagram of the dimmer drive circuit 204 of the integrated LED controller 202, according to one embodiment. The dimmer drive circuit 204 includes a signal generator 302, a dimmer driver 304, and a timing controller 306.

The signal generator 302 generates an intermediate signal 303 for the dimmer driver 304. In one embodiment, the signal generator 302 generates a pulse train with a duty cycle, as shown in FIG. 3A. For example, the intermediate signal 303 is a digital signal that alternates between a high value for 5 ms and by a low value for 10 ms. The signal generator 302 may alternatively generate a square wave, a sine wave, or some other periodic signal. The period of the intermediate signal 303 generated by the signal generator 302 may be fixed, or the period may vary.

The driver 304 receives the intermediate signal 303 from the signal generator 302 and generates a driving signal 205 for the passive dimmer 206. As described above with reference to the dimmer read circuit 204 in FIG. 2, the driving signal 205 is a constant current with a duty cycle. In one embodiment, the driver 304 operates by generating the constant current (e.g., 1 mA) when the intermediate signal 303 is high and generating a low current (e.g., 0 mA) when the intermediate signal 303 is low. Thus, the duty cycle of the driving signal 205 matches the duty cycle of the intermediate signal 303 generated by the signal generator 302.

The timing controller 306 generates a control signal 308 for the signal generator 302. In one embodiment, the signal generator 302 is configured to generate the pulse train shown in FIG. 3A when the control signal 308 is high and to generate a low signal when the control signal 308 is low. The control signal 308 may include additional channels that define other aspects of the intermediate signal 303, such as its period, phase, and duty cycle.

Figure 3B:
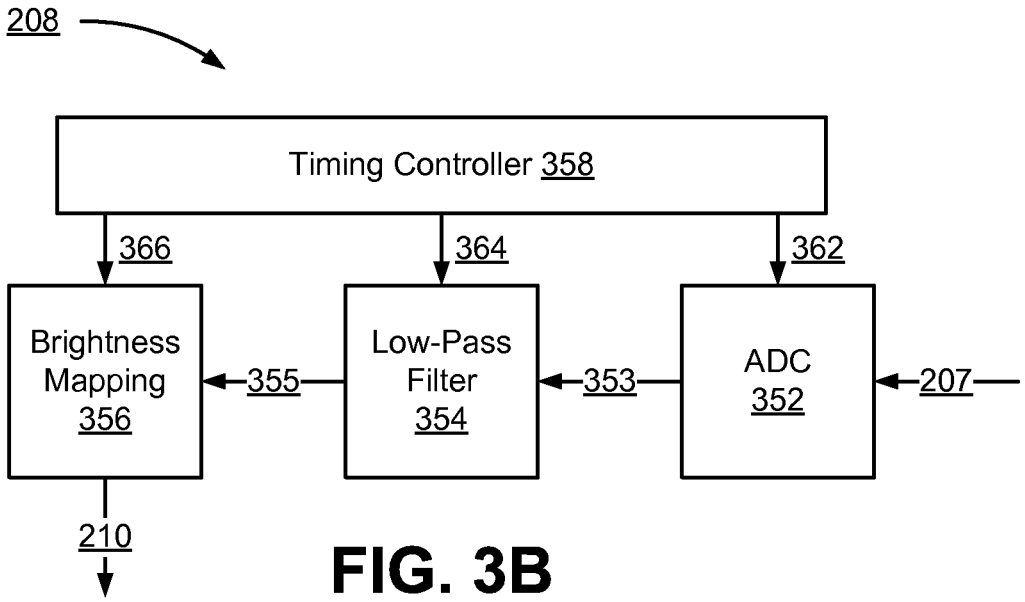
FIG. 3B is a block diagram of the dimmer read circuit of the integrated LED controller, according to one embodiment.

FIG. 3B is a block diagram of the dimmer read circuit 208 of the integrated LED controller 202, according to one embodiment. The dimmer read circuit 208 includes an analog-to-digital converter (ADC) 352, a low-pass filter 354, a brightness mapping 356, and a timing controller 358.

The ADC 352 captures samples of the analog dimmer signal 207 and converts the samples into digital values to generate a digital dimmer signal 353. The sampling rate and sample times of the ADC 352 are determined by an ADC control signal 362 that the ADC 352 receives from the timing controller 358. For example, the ADC 352 captures samples on rising edges (e.g., low-to-high transitions) of the ADC control signal 362. The ADC control signal 362 may also cause the ADC 352 to stop sampling altogether (e.g., by maintaining a low value). In some embodiments, the ADC 352 is omitted, and the dimmer read circuit 208 receives the digital dimmer signal 353. For example, the dimmer 206 may be a digital dimmer, as described above with reference to FIG. 2. Alternatively, the system 200 may include a discrete ADC that receives the analog dimmer signal 207 and provides a digital dimmer signal to integrated LED controller 202 for input to the dimmer read circuit 208. The different ways in which an ADC can convert an analog signal into a digital signal are widely known in the art and a description thereof will be omitted from this description for the sake of brevity.

The low-pass filter 354 applies a low-pass filter to the digital dimmer signal 353 to generate a filtered dimmer signal 355. Applying a low-pass filter can beneficially reduce any noise that may have been added to the analog dimmer signal 207 (e.g., due to crosstalk or electromagnetic interference) in the external wiring between the integrated LED controller 202 and the passive dimmer 206. The low-pass filter 354 may be omitted in embodiments where the analog dimmer signal 207 is not subject to a significant amount of noise or where cost reduction is a higher priority than noise reduction. The functionality of a digital low-pass filter is also widely known in the art and a description thereof will be omitted from this description.

The brightness mapping 356 receives the filtered dimmer signal 355 and maps the dimmer signal 355 to a brightness corresponding to the position of the slider on the passive dimmer 206. The brightness is outputted from the dimmer read circuit 208 as a digital brightness signal 210. In embodiments where a non-linear relationship exists between the slider position and the analog dimmer signal 204, the brightness mapping 356 can be configured to create a linear relationship between the slider position and the driver current 217 for the LED 218. For example, suppose the analog dimmer signal 207 has a range of 0-2 V but has a value of 0.8 V (rather than 1.0 V) when the slider is exactly halfway between its minimum position and its maximum position. The brightness mapping 356 would thus receive a digital value corresponding to 0.8 V when the slider is in the halfway position. In this case, the brightness mapping 356 can be configured to map that digital value to a digital brightness signal 210 representing half of the LED's maximum brightness. As a result, the LED 218 still receives a driver current 217 at half of the maximum driver current when the slider is in its halfway position even though there is a non-linear relationship between the slider position and the analog dimmer signal 207.

The brightness mapping 356 can also be configured to create a non-linear relationship between the position of the slider and the driver current 217 for the LED 218 when a linear relationship exists between the slider position and the analog dimmer signal 207. Alternatively, the brightness mapping 356 can be configured to map a non-linear relationship (e.g., quadratic) between the slider position and the analog dimmer signal 207 to a different non-linear relationship (e.g., exponential) between the slider position and the driver current 217 for the LED 218.

In an alternative embodiment, the ADC 352 is replaced with an analog sample and hold circuit, and the low-pass filter 354 is implemented as an analog low-pass filter. In this embodiment, the brightness mapping 356 may also be an analog component, or an ADC may be added between the analog low-pass filter 354 and a digital brightness mapping 356.

The timing controller 358 generates control signals 362, 364, 366 that control the operation of the ADC 352, the low-pass filter 354, and the brightness mapping 356. In one embodiment, the control signals 362, 364, 366 are clock signals for the three components 352, 354, 356. The components 352, 354, 356 may be clocked synchronously or asynchronously.

Figure 4A:
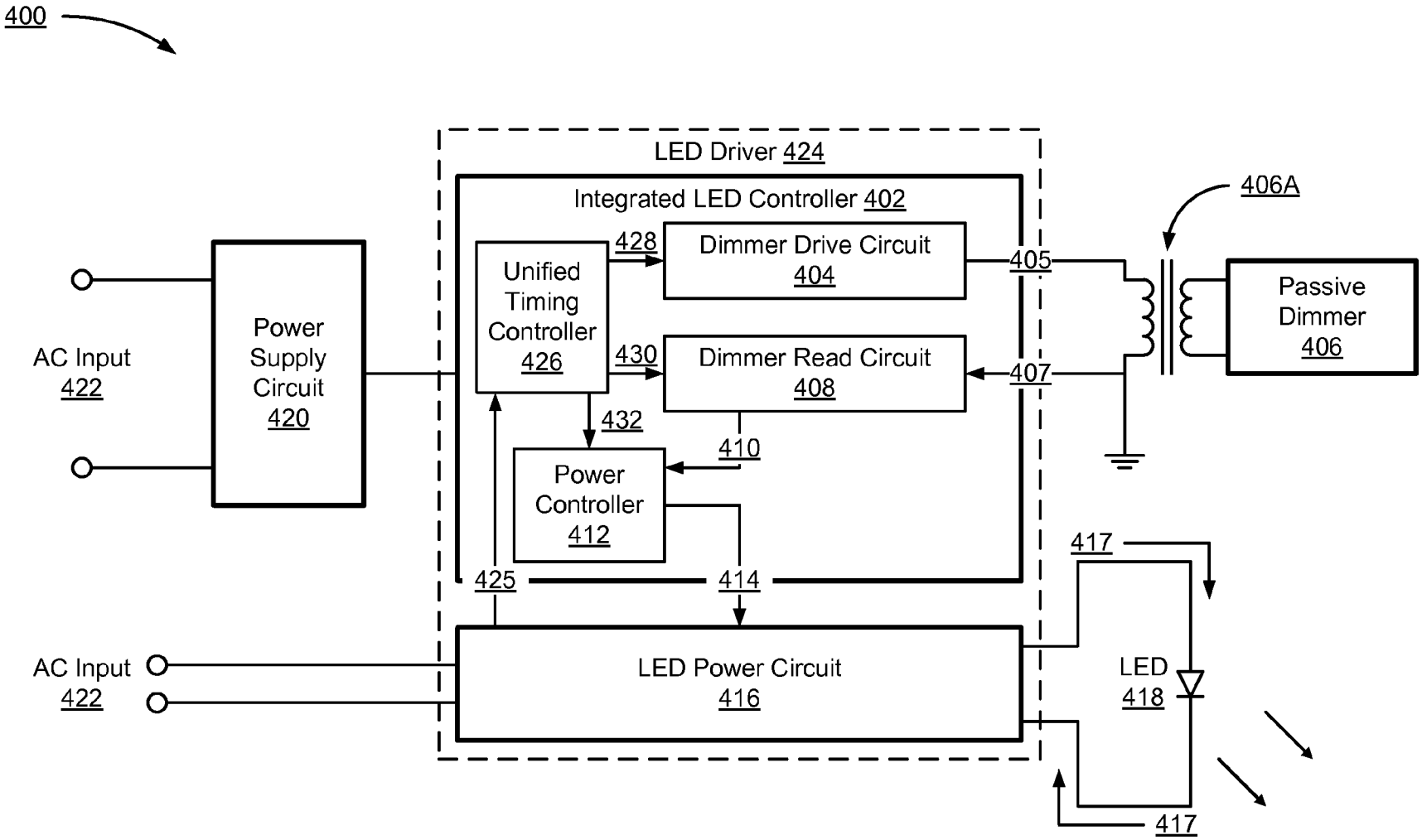
FIG. 4A is a block diagram illustrating a system for dimming an LED with another embodiment of an integrated LED controller.

FIG. 4A is a block diagram illustrating a system 400 for dimming an LED 418 with another embodiment of an integrated LED controller 402. The dimmer drive circuit 404, passive dimmer 406, transformer 406A, dimmer read circuit 408, power controller 412, LED power circuit 416, LED 418, and power supply circuit 420 perform similar functions as the corresponding components in the system 200 shown in FIG. 2. In addition, the dimmer drive circuit 404 in FIG. 4A includes a signal generator 302 and a dimmer driver 304, as described with reference to FIG. 3A. Meanwhile, the dimmer read circuit 408 includes an ADC 352 and brightness mapping 356 and may optionally include a low-pass filter 354, as described with reference to FIG. 3B.

The integrated LED controller 402 shown in FIG. 4A also includes a unified timing controller 426. The unified timing controller 426 receives input signals 425 and generates driver control signals 428 and reader control signals 430 in a manner that reduces the system's sensitivity to noise. In embodiments with a unified timing controller 426, the individual timing controllers 306, 358 in the dimmer drive circuit 404 and the dimmer read circuit 408 can be omitted, and the control signals 428, 430 generated by the unified timing controller 426 are used in place of the control signals 308, 362, 364, 366 generated by the individual timing controllers 306, 358. In other embodiments, the control signals 428, 430 generated by the unified timing controller 426 replace a subset of the control signals 308, 362, 364, 366 generated by the individual timing controllers 306, 358, and the individual timing controllers 306, 358 generate the remaining control signals. The unified timing controller 426 may further generate a control signal 432 for the power controller 412 that can be used to coordinate the timing of the power control signals 414 with timing of the dimmer drive circuit 404 and the dimmer read circuit 408.

Figure 4B:
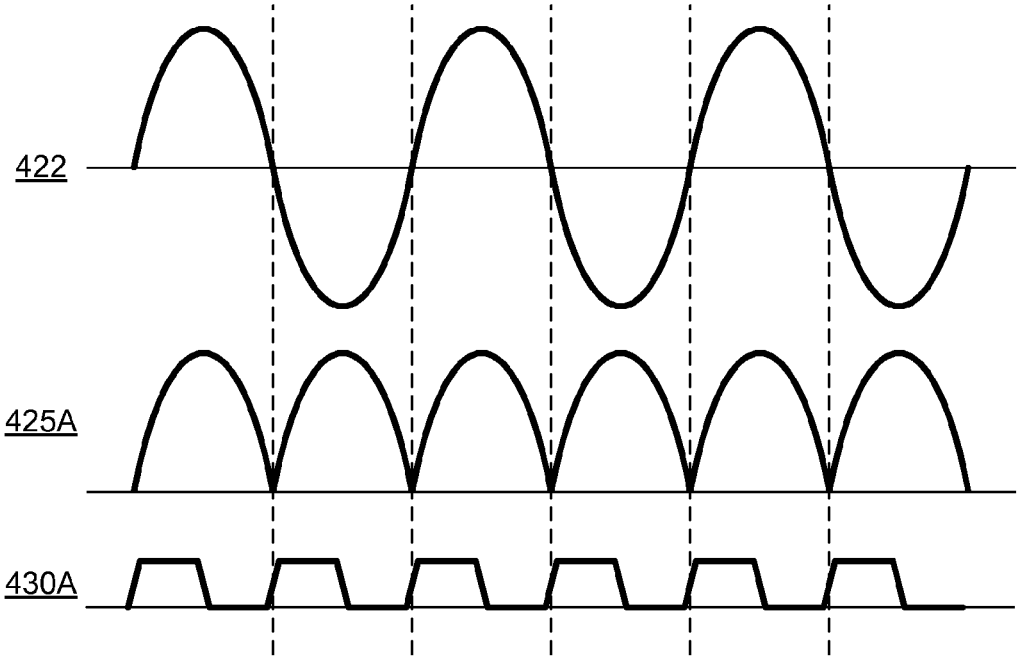
FIGS. 4B and 4C are waveforms illustrating the operation of the unified timing controller, according to one embodiment.
Figure 4C:
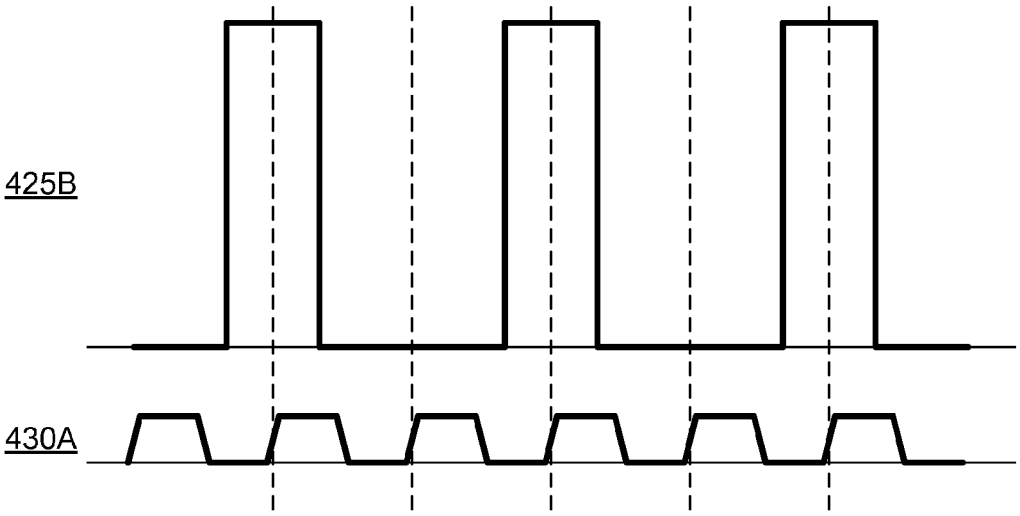

FIGS. 4B and 4C each illustrate a set of waveforms that demonstrate how the unified timing controller 426 can be configured to reduce noise sensitivity. For the sake of example, it is assumed in FIGS. 4B and 4C that the ADC control signal 430A (one of the reader control signals 430 sent from the unified timing controller 426 to the dimmer read circuit 408) is a binary signal and that the ADC 352 takes samples of the analog dimmer signal 407 on rising edges of the ADC control signal 430A. However, the ADC 352 may instead be configured to take samples on falling edges of the ADC control signal 430A. In addition, the ADC 352 may have an aperture delay that causes it to take each sample at a certain time after each rising edge or falling edge.

In the example shown in FIG. 4B, one of the input signals 425 to the unified timing controller 426 is an AC signal 425A that represents the AC input 422 after the AC input 422 passes through a rectifier in the power supply circuit 420 or the LED power circuit 416, and the unified timing controller 426 generates an ADC control signal 430A that causes the ADC 352 to capture samples when the AC signal 425A is close to 0. Controlling the timing of the ADC 352 in this manner causes the ADC to take samples when the AC input 422 is near 0 V, which advantageously reduces the noise that the AC input 422 introduces into the signal path when the ADC 352 captures and converts a sample of the analog dimmer signal 407.

In one embodiment, the unified timing controller 426 includes a separate analog-to-digital converter that digitizes the AC signal 425A and further includes a digital comparator that compares the digital AC signal to a threshold value. For example, the threshold value may be the value of an AC signal 425A corresponding to an AC input 422 of between −15 V and 15 V. If the digital AC signal is less than the threshold value, then the unified timing controller 426 allows the ADC control signal 430A to transition from a low value to a high value. The unified timing controller 426 may alternatively use an analog comparator to compare the AC signal 425A to the threshold value.

As a separate example, the input signals 425 may include a switching signal 425B representing switching events in the LED power circuit 416, as shown in FIG. 4C. For example, the switching signal 425B represents the action of a switch in a flyback converter that is part of the LED power circuit 416. In these embodiments, the unified timing controller 426 coordinates the ADC control signal 430A so that the ADC 352 does not capture samples while switching is taking place in the LED power circuit 416. Instead, the ADC 352 takes samples between switching events. Since noise is higher during switching events in the LED power circuit 216, preventing the ADC 352 from sampling during these switching events also reduces noise when the ADC 352 captures and converts a sample of the analog dimmer signal 407.

In one embodiment, the unified timing controller 426 implements this functionality by preventing the ADC control signal 430A from transitioning from a low value to a high value during a predetermined time interval after each switching event in the LED power circuit 416. For example, the unified timing controller 426 coordinates the ADC control signal 430A so that it transitions at least 200 nanoseconds (ns) after the unified timing controller 426 detects a switching event.

In embodiments where the switching in the LED power circuit 416 has a consistent period and duty cycle, the unified timing controller 426 may also prevent low-to-high transitions in the ADC control signal 430A during a predetermined time interval before each switching event. The beginning of the predetermined time interval can be determined by predicting the time at which the next switching event will occur. For example, if the switch consistently switches back to the off state 10 microseconds (μs) after switching to the on state, the unified timing controller 426 may prevent the ADC control signal 430A from transitioning during a time interval beginning 9000 ns after the switch switches into the on position. This has the effect of preventing the ADC control signal 430A from performing a low-to-high transition less than 1000 ns before the switch switches to the off state.

Since the unified timing controller 426 also generates a control signal 432 for the power controller 412, the unified timing controller 426 can also prevent sampling prior to a switching event by causing the power controller 412 to delay the next switching event. For example, after the unified timing controller 426 generates a low-to-high transition in the ADC control signal 425B, the unified timing controller 426 may configure the control signal 432 to prevent the next switching event from occurring less than 1000 ns after the transition.

In some embodiments, the unified timing controller 426 is configured to perform both of the noise-reduction processes described with reference to FIGS. 4B and 4C. Thus, the unified timing controller 426 allows low-to-high transitions in the ADC control signal 430A only when the conditions described above in relation to the AC signal 425A and the switching signal 425B are both met.

Adding a unified timing controller 426 to reduce noise sensitivity in the manners described with reference to FIGS. 4B and 4C is possible because the dimmer drive circuit 404, the dimmer read circuit 408, and the power controller 412 are integrated into a single physical component 402. In a conventional system 100 where these functions are performed by discrete components, it would be difficult and impractical to add a unified timing controller to coordinate timing between components due to the delays and interference associated with transferring signals over external communication channels such as PCB traces and wires.

In some embodiments, the unified timing controller 426 is further configured to detect changes in the slider position on the passive dimmer 406. For example, the unified timing controller 426 periodically polls the passive dimmer 406 (e.g., every 15 ms) to determine the position of the slider. In these embodiments, the unified timing controller 426 generates control signals 428, 430 that cause the dimmer drive circuit 404 and the dimmer read circuit 408 to operate only when a change in the slider position is detected. For example, when the slider position is changing, the driver control signals 428 causes the dimmer drive circuit 404 to generate the driving signal 405 and the reader control signals 430 cause the dimmer read circuit 408 to sample the analog dimmer signal 407 and generate the brightness signal 410.

Meanwhile, if no change in the slider position is detected, the driver control signal 428 causes the dimmer drive circuit 404 to stop generating the driving signal 405 (e.g., by causing the signal generator 302 to power down or generate a low intermediate signal 303), and the reader control signals 430 cause the ADC 352 to stop capturing samples and further cause the brightness mapping 356 to output a constant brightness signal 410 with a brightness value corresponding to the most recent sample that was collected.

Operating the dimmer drive circuit 404 and the dimmer read circuit 408 in this manner advantageously reduces the power consumption of the integrated LED controller 402 while the slider position is not changing. In addition, since the brightness mapping 356 continues to output the most recent brightness value when the slider position is not changing, the operation of the power controller 412 and the LED power circuit 416 is not interrupted.

Figure 5:
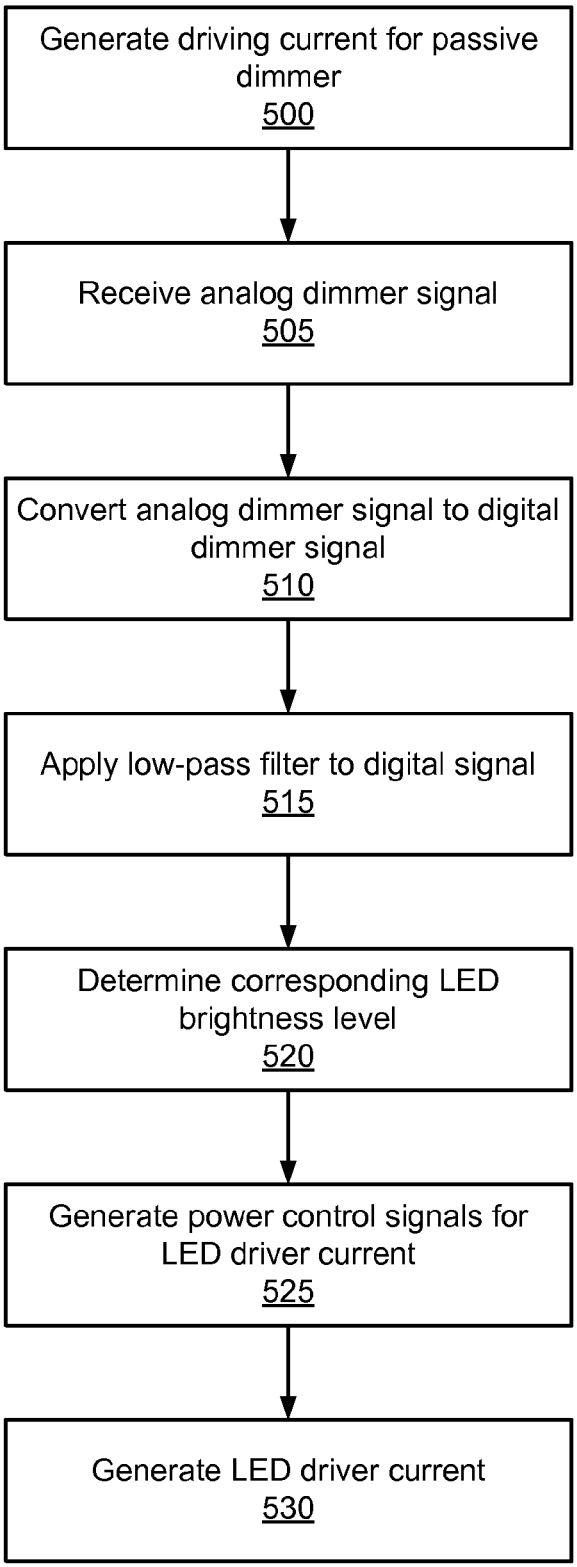
FIG. 5 is a flow chart describing the operation of the integrated LED controller, according to one embodiment.

FIG. 5 is a flow chart describing the operation of the integrated LED controllers 202 and 402, according to one embodiment. Although only the components of FIG. 2 are referenced in the description below, the process shown in FIG. 5 also applies to the embodiment shown FIG. 4.

The process begins when the dimmer drive circuit 204 generates 500 a driving signal 205 for the passive dimmer 206. The ADC 352 in the dimmer read circuit 208 receives 505 an analog dimmer signal 207 from the passive dimmer 206 and converts 510 the analog dimmer signal 207 into a digital dimmer signal 353 by capturing samples of the analog dimmer signal 207. A low-pass filter 354 can optionally be applied 515 to the digital dimmer signal 353 to reduce noise. The brightness mapping 356 receives the filtered dimmer signal 355 and determines 520 a corresponding LED brightness level, which is sent to the power controller 212 as a digital brightness signal 210. The power controller 212 uses the digital brightness signal 210 to generate 525 one or more power control signals 214, and the LED power circuit 216 generates 530 a corresponding LED driver current 217 that causes the LED 218 to emit light at the brightness level indicated by the digital brightness signal 210.

Figure 6:
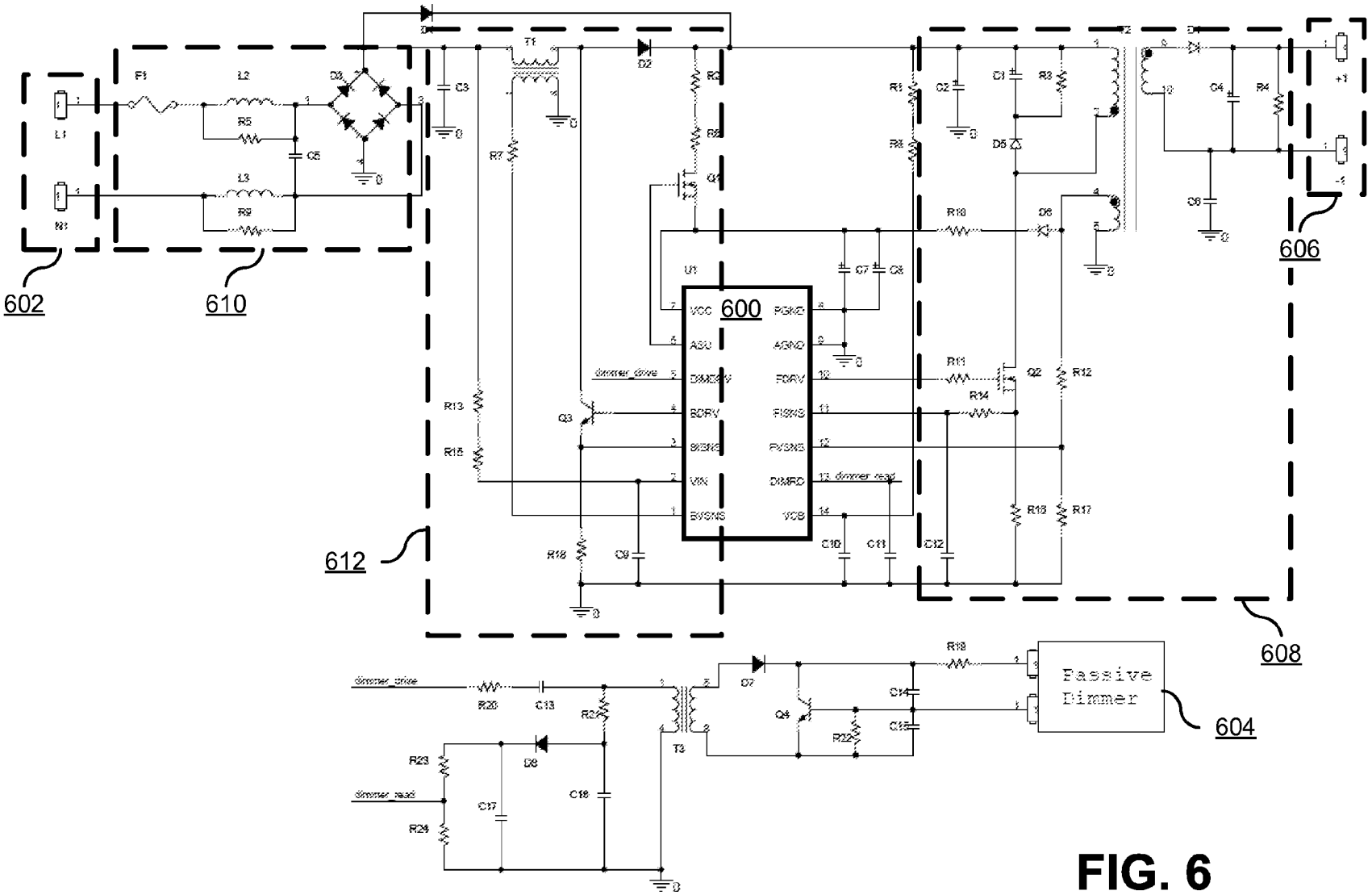
FIG. 6 is an electronic schematic illustrating an example application circuit for the integrated LED controller, according to one embodiment.

FIG. 6 is an electronic schematic illustrating an example application circuit for the integrated LED controller 600. The integrated LED controller 600 is shown in the middle and is coupled to an AC input 602 at the top-left, a passive dimmer at the bottom-right, and an output port 606 for the LED at the top-left. The application circuit includes a flyback converter 608 that provides a driver current to the output port 606 for the LED and further includes a rectifier 610 and boost converter 612 that power the integrated LED controller 600 and the flyback converter 608. Together, the rectifier 610, boost converter 612, and flyback converter 608 perform the functions of the LED power circuit 216, 416 and the power supply circuit 220, 420 described with reference to FIG. 2 and FIG. 4.

Pin 5 of the integrated LED controller 600 outputs the driving signal 205, 405 to the passive dimmer, and the integrated LED controller 600 receives the analog dimmer signal 207, 407 from the passive dimmer at pin 13.

Pins 4 and 10 output power control signals 214, 414 that control various functions associated with generating and regulating the driver current for the LED at the top-left. In particular, pin 4 controls a transistor that performs switching in the boost converter 612, while pin 10 controls a transistor that performs switching in the flyback converter 608.

Pins 1, 3, 11 and 12 receive feedback signals from various portions of the boost converter 612 and the flyback converter 608. These feedback signals can be used as input signals 425 to the unified timing controller 426. For example, pin 1 receives a signal representing the rectified AC input 602, which can be used in accordance with the techniques described with reference to FIG. 4B. Meanwhile, pins 11 and 12 receive signals representing switching events in the flyback converter 608 that can be used in the manner described with reference to FIG. 4C.

Pins 6, 7, 8, and 9 provide power to the integrated LED controller 600 by connecting the controller 600 to a power supply and to ground.

Pins 2 and 14 receive the rectified AC input voltage and the internal bus voltage to provide protection against abnormal conditions, such as abnormally high voltages caused by lightning events.

Upon reading this disclosure, those of skill in the art will appreciate still additional alternative designs for an integrated LED controller. Thus, while particular embodiments and applications of the present invention have been illustrated and described, it is to be understood that the invention is not limited to the precise construction and components disclosed herein and that various modifications, changes and variations which will be apparent to those skilled in the art may be made in the arrangement, operation and details of the method and apparatus of the present invention disclosed herein.

What is claimed is:

1. An integrated circuit for controlling a light emitting diode (LED), comprising:

a dimmer drive circuit configured to receive a driver control signal and to output a driving signal to a passive dimmer having an adjustable control position, wherein the passive dimmer generates a dimmer signal from the driving signal, the dimmer signal representing a control position of the adjustable control position of the passive dimmer;

a dimmer read circuit configured to receive a reader control signals and the dimmer signal from the passive dimmer and further configured to generate a brightness signal representing a desired brightness level of the LED based on the dimmer signal;

a power controller coupled to the dimmer read circuit and configured to receive the brightness signal from the dimmer read circuit, and generate one or more power control signals, the power control signals capable of causing the LED to emit light at the desired brightness level; and a unified timing controller coupled to the dimmer drive circuit and the dimmer read circuit, the unified timing controller configured to receive one or more input signals generated by an LED power circuit coupled to the integrated circuit and a signal indicative of a change in the control position of the passive dimmer, and further configured to generate, based on the input signals, the driver control signal to control operation of the dimmer drive circuit and the reader control signals to control operation of the dimmer read circuit.

2. The integrated circuit of claim 1, wherein the dimmer drive circuit comprises:

a signal generator configured to generate an intermediate signal based on the driver control signal, wherein the intermediate signal alternates between a low value and a high value when the driver control signal has a high value, and wherein the intermediate signal has the low value when the driver control signal has a low value; and a dimmer driver configured to receive the intermediate signal and generate the driving signal for the passive dimmer, wherein the driving signal is a high current when the intermediate signal has a high value, and wherein the driving signal is a low current when the intermediate signal has a low value.

3. The integrated circuit of claim 1, wherein the dimmer signal is an analog signal, wherein the reader control signals comprise an analog-to-digital converter (ADC) control signal, and wherein the dimmer read circuit comprises:

an analog-to-digital converter (ADC) configured to capture samples of the analog dimmer signal at time intervals defined by the ADC control signal, the captured samples forming a digital dimmer signal representing the analog dimmer signal; and a brightness mapping coupled to the ADC and configured to generate the brightness signal.

4. The integrated circuit of claim 3, wherein the dimmer read circuit further comprises:

a digital low-pass filter configured to perform low-pass filtering on the digital dimmer signal to generate a filtered dimmer signal, wherein the brightness mapping generates the brightness signal based on the filtered dimmer signal.

5. The integrated circuit of claim 3, wherein the input signals for the unified timing controller comprise an alternating current (AC) signal representing an AC power supply for the LED power circuit, and wherein the ADC control signal causes the ADC to capture the samples while the AC signal is below a threshold voltage.

6. The integrated circuit of claim 3, wherein the input signals for the unified timing controller comprise a switching signal representing switching events occurring in an LED power circuit coupled to the integrated circuit, and wherein the ADC control signal causes the ADC to capture the samples during a time interval between switching events.

7. The integrated circuit of claim 1, wherein the integrated circuit is coupled to an LED power circuit comprising a flyback converter, and wherein the power control signals comprise a switching signal for a switch in the flyback converter.

8. The integrated circuit of claim 1, wherein the passive dimmer is an analog dimmer configured to output a maximum voltage when the control position is at a maximum position and further configured to output a minimum voltage when the control position is at a minimum position.

9. A method for operating a light emitting diode (LED) controller, comprising:

generating, in an integrated circuit, a driving signal for output to a passive dimmer, the passive dimmer having an adjustable control position, wherein the passive dimmer generates a dimmer signal form the driving signal, the dimmer signal representing a control position of the adjustable control position of the passive dimmer;

receiving, at the same integrated circuit, a dimmer signal from the passive dimmer;

generating, based on the dimmer signal, a brightness signal representing a desired brightness level of the LED;

generating one or more power control signals based on the brightness signal, the one or more power control signals capable of causing the LED to emit light at the desired brightness level.

10. The method of claim 9, further comprising:

receiving one or more input signals;

generating, based on the input signals, a driver control signal to control the generation of the driving signal; and generating, based on the input signals, reader control signals to control the generation of the brightness signal.

11. The method of claim 10, wherein generating the driving signal comprises:

generating an intermediate signal based on the driver control signal, wherein the intermediate signal alternates between a low value and a high value when the driver control signal has a high value, and wherein the intermediate signal has the low value when the driver control signal has a low value; and generating a driving signal for the passive dimmer based on the intermediate signal, wherein the driving signal is a high current when the intermediate signal has a high value, and wherein the driving signal is a low current when the intermediate signal has a low value.

12. The method of claim 10, wherein the dimmer signal is an analog signal, wherein generating the reader control signals comprises generating an analog-to-digital converter (ADC) control signal, and wherein generating the brightness signal comprises:

capturing samples of the analog dimmer signal with an analog-to-digital converter (ADC) at times defined by the ADC control signal, the captured samples forming a digital dimmer signal representing the analog dimmer signal.

13. The method of claim 12, wherein generating the brightness signal further comprises:

performing low-pass filtering on the digital dimmer signal to generate a filtered dimmer signal; and generating the brightness signal based on the filtered dimmer signal.

14. The method of claim 12, wherein receiving one or more input signals from the LED power circuit comprises receiving an alternating current (AC) signal representing an AC power supply for the LED power circuit, and wherein generating the ADC control signal comprises causing the ADC to capture samples responsive to detecting that the AC signal is below a threshold voltage.

15. The method of claim 12, wherein receiving one or more input signals from the LED power circuit comprises receiving a switching signal representing switching events occurring in the LED power circuit, and wherein generating the ADC control signal comprises causing the ADC to capture samples during a time interval between switching events.

16. The method of claim 9, wherein the LED power circuit comprises a flyback converter, and wherein generating the power control signals comprises generating a switching signal for a switch in the flyback converter.

17. The method of claim 9, wherein the passive dimmer outputs a maximum voltage when the control position is at a maximum position, and wherein the passive dimmer outputs a minimum voltage when the control position is at a minimum position.

18. An integrated circuit for controlling a light emitting diode (LED), comprising:

a dimmer drive circuit configured to output a driving signal to a passive dimmer having an adjustable control position, wherein the passive dimmer generates a dimmer signal from the driving signal, the dimmer signal representing a control position of the adjustable control position of the passive dimmer;

a dimmer read circuit configured to receive a dimmer signal from the passive dimmer and further configured to generate a brightness signal representing a desired brightness level of the LED based on the analog dimmer signal; and a power controller coupled to the dimmer read circuit and configured to receive the brightness signal from the dimmer read circuit, and generate one or more power control signals, the power control signals capable of causing the LED to emit light at the desired brightness level.

19. The integrated circuit of claim 18, wherein the dimmer drive circuit comprises:

a driver timing controller configured to generate a driver control signal;

a signal generator configured to generate an intermediate signal based on the driver control signal, wherein the intermediate signal alternates between a low value and a high value when the driver control signal has a high value, and wherein the intermediate signal has the low value when the driver control signal has a low value; and a dimmer driver configured to receive the intermediate signal and generate the driving signal for the passive dimmer, wherein the driving signal is a high current when the intermediate signal has a high value, and wherein the driving signal is a low current when the intermediate signal has a low value.

20. The integrated circuit of claim 18, wherein the dimmer signal is an analog dimmer signal, and wherein the dimmer read circuit comprises:

a reader timing controller configured to generate an analog-to-digital converter (ADC) control signal;

an analog-to-digital converter (ADC) configured to capture samples of the analog dimmer signal at time intervals defined by the ADC control signal, the captured samples forming a digital dimmer signal representing the analog dimmer signal; and a brightness mapping coupled to the ADC and configured to generate the brightness signal.

21. The integrated circuit of claim 20, wherein the dimmer read circuit further comprises:

a digital low-pass filter configured to perform low-pass filtering on the digital dimmer signal to generate a filtered dimmer signal, wherein the brightness mapping generates the brightness signal based on the filtered dimmer signal.

22. The integrated circuit of claim 18, wherein the integrated circuit is coupled to an LED power circuit comprising a flyback converter, and wherein the power control signals comprise a switching signal for a switch in the flyback converter.

23. The integrated circuit of claim 18, wherein the passive dimmer is an analog dimmer configured to output a maximum voltage when the control position is at a maximum position and further configured to output a minimum voltage when the control position is at a minimum position.

* * * * *